US006122829A

United States Patent [19]

McHenry et al.

[11] Patent Number: 6,122,829

[45] Date of Patent: *Sep. 26, 2000

[54] FOLDING TOOL

[75] Inventors: William J. McHenry; Jason L. Williams, both of Wyoming, R.I.

[73] Assignee: Mentor Group, L.L.C., West Linn, Oreg.

[ * ] Notice: This patent is subject to a terminal disclaimer.

[21] Appl. No.: 09/060,196

[22] Filed: Apr. 14, 1998

Related U.S. Application Data

[63] Continuation-in-part of application No. 08/679,122, Jul. 12, 1996, Pat. No. 5,737,841.

[51] Int. Cl.[7] ..... B26B 1/04

[52] U.S. Cl. ..... 30/161; 30/160

[58] Field of Search ..... 30/160, 161, 331, 30/133; 7/118

[56] References Cited

U.S. PATENT DOCUMENTS

| | | | |
|---|---|---|---|
| 1,030,058 | 6/1912 | Doles . | |
| 1,189,005 | 6/1916 | Seely . | |
| 2,188,762 | 1/1940 | Schrade | 30/160 |
| 3,868,774 | 3/1975 | Miori | 30/161 |
| 4,233,737 | 11/1980 | Poehlmann | 30/335 |
| 4,240,201 | 12/1980 | Sawby et al. | 30/161 |
| 4,274,200 | 6/1981 | Coder | 30/161 |
| 4,451,982 | 6/1984 | Collins | 30/161 |
| 4,502,221 | 3/1985 | Pittman | 30/160 |
| 4,670,984 | 6/1987 | Rickard | 30/161 |
| 4,837,932 | 6/1989 | Elsener | 30/161 |
| 4,896,424 | 1/1990 | Walker | 30/349 |
| 4,974,323 | 12/1990 | Cassady | 30/155 |
| 5,060,379 | 10/1991 | Neely | 30/161 |
| 5,111,581 | 5/1992 | Collins | 30/161 |
| 5,425,175 | 6/1995 | Rogers | 30/161 |
| 5,461,786 | 10/1995 | Miller | 30/161 |
| 5,495,674 | 3/1996 | Taylor, Jr. | 30/160 |
| 5,615,484 | 4/1997 | Pittman | 30/161 |
| 5,685,079 | 11/1997 | Brothers et al. | 30/161 |

*Primary Examiner*—Douglas D. Watts
*Attorney, Agent, or Firm*—Ipsolon LLP

[57] ABSTRACT

A folding tool includes an elongate handle and a blade pivotally attached to the handle. The blade is movable between a closed position in which it is received within a groove, between the side walls of the handle, and an open position in which the blade extends away from the handle and is exposed. The blade has a tang portion which is received within the groove of the handle when the blade is in its open position. A blade locking pin is part of a sliding lock assembly and extends generally transversely with respect to the length of the handle and blade. The pin is movable along a pair of elongate holes, between a first position in which the pin engages the tang portion to lock the blade in its open position and a second position in which the pin is spaced away from the tang and allows the blade to move to its closed position. A spring is biases the pin to its first position and is further provided for manually moving the pin to its second position from its biased first position.

10 Claims, 6 Drawing Sheets

FOLDING TOOL

This application is a continuation-in-part of U.S. patent application Ser. No. 08/679,122 filed Jul. 12, 1996, now U.S. Pat. No. 5,737,841.

BACKGROUND OF THE INVENTION

This invention relates generally to folding tools, and more particularly to a pocket knife whose blade is capable of being locked in an open position.

Folding knives suitable for many purposes are well known in the art. For example, U.S. Pat. Nos. 1,030,058 to Doles, 1,189,005 to Seely, 2,188,762 to Schrade, 3,868,774 to Miori, 4,2233,737 to Poehlmann, 4,240,201 to Sawby et al., 4,274,200 to Coder, 4,451,982 to Collins, 4,502,221 to Pittman, 4,670,984 to Rickard, 4,837,932 to Elsener, 4,896,424 to Walker, 5,060,379 to Neely, 5,425,175 to Rogers, and 5,461,786 to Miller are representative of the available prior art.

As disclosed in several of the aforementioned patents, there are many different mechanisms for locking tool blades in an open position. For example, the patents to Sawby et al., Miller and Seely each disclose a variation of a "lock back" mechanism. This construction entails forming a notch on a tang of the blade which is engaged by a lug located on the spine of the knife to lock the blade in an open position. A shortcoming of this type of mechanism is that excessive wear can cause the locking mechanism to fail, thereby rendering the knife unsafe for use.

The patents to Neely and Collins each disclose another type of locking mechanism. As disclosed in these patents, a blade has a tang that is engaged by a member to prevent the blade from rotating from its open position. For example, in Collins, a slidable bolt is biased towards the tang to lock the blade in its open position. A shortcoming with Collins's knife construction is that the bolt is generally parallel with the blade, and the mechanism depends on the spine of the handle for strength. Neely's knife suffers from the same disadvantage as Collins's, and from the fact that the blade may be unlocked inadvertently by pulling the blade axially away from the handle during a normal cutting motion of the knife.

What is needed, then, is a stronger lock mechanism than has previously been available for holding a blade of a folding tool in an open, or extended, position, yet which is capable of being manufactured at a reasonable cost.

SUMMARY OF THE INVENTION

The present invention overcomes the above-mentioned shortcomings of the prior art by providing a folding tool comprising an elongate handle defining an elongate groove therein and at least one knife or other tool blade or other tool element pivotally attached to the handle at one end. Each tool blade or element is movable, between a closed position in which it is received within the groove of the handle and an open position in which the blade or tool element is extended away from the handle and exposed. Each tool blade has a working portion that extends away from the handle when in its open position and a tang portion including a locking surface which is located within the groove of the handle when the blade is in its open position. A blade locking pin extends in a direction generally transverse to the length of the handle and blade and has its opposite ends disposed in elongate openings defined in opposite sides of the handle and aligned opposite each other. The blade locking pin is movable with respect to the handle along the elongate openings, between a first position, in which the locking pin engages a locking surface of the tang portion of blade as well as interior surfaces of the elongate openings, to lock the blade in its open position, and a second position in which the pin is spaced away from the locking surface portion of the tang to allow the blade to move from its open position. The locking pin is biased resiliently toward its first position. In a preferred embodiment of the invention a lock body is provided to manually move the pin to its second position from its first position.

In one embodiment of the invention the blade locking pin is biased toward the first position by a spring housed in a cavity in the handle.

In one embodiment of the invention a spine portion of the handle is located adjacent the elongate openings in which the ends of the blade locking pin are located, and respective parts of an outer surface of the blade locking pin rest against the locking surface on the tang of the blade and a surface of the spine.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
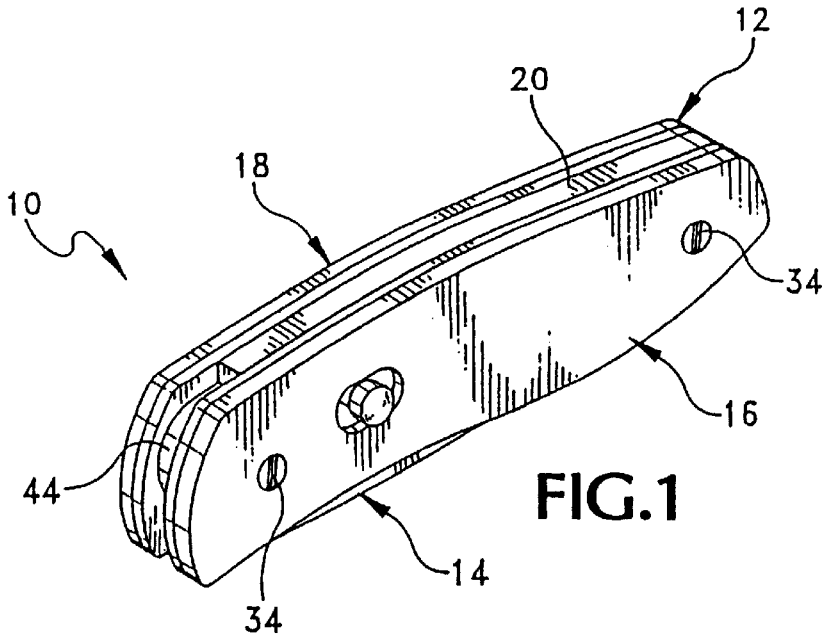
FIG. 1 is a perspective view of a folding or pocket knife embodying the present invention, a blade of the knife being shown in a closed position in which it is received within a handle of the knife.
Figure 2:
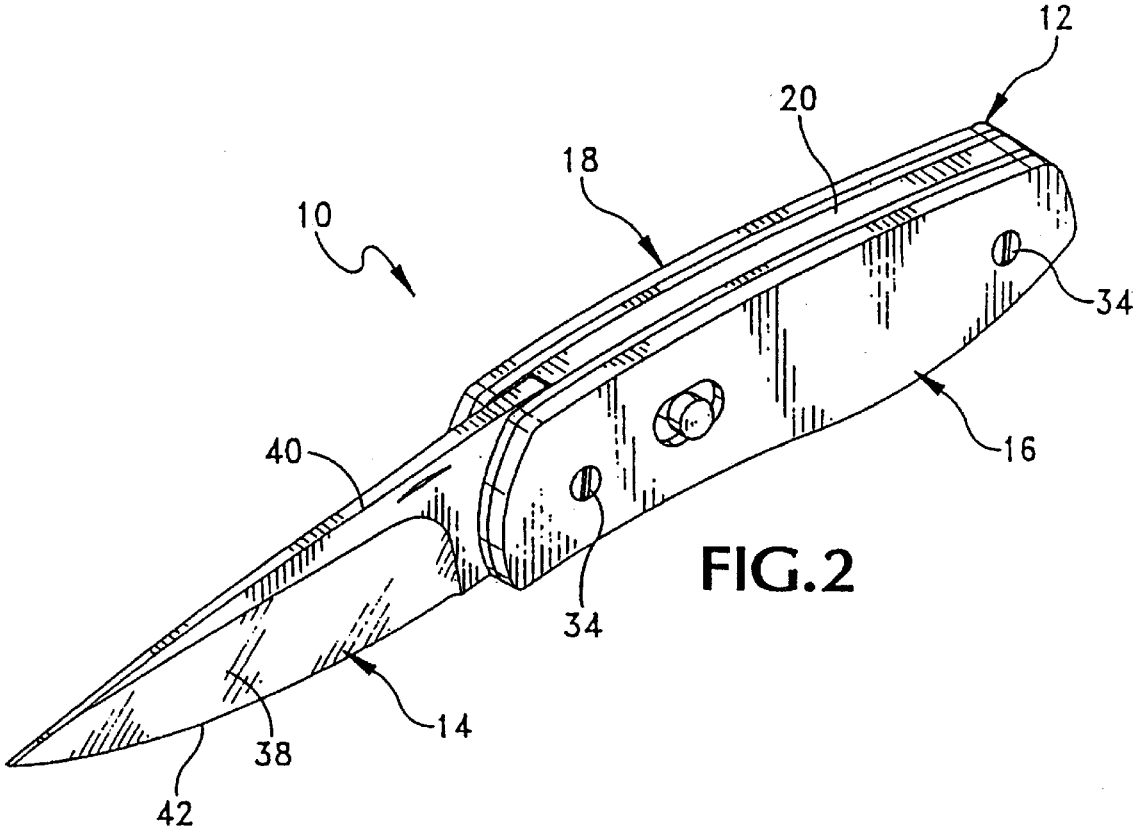
FIG. 2 is a perspective view of the knife shown in FIG. 1, with the blade of the knife being shown in an open, operating position.

Referring now to the drawings, and more particularly to FIGS. 1 and 2, a folding pocket knife 10 includes a blade locking mechanism that embodies the present invention. The pocket knife 10 includes an elongate handle 12, and a blade 14 that is pivotally attached to the handle at one of its opposite ends. FIG. 1 shows the pocket knife 10 with the blade 14 in a closed position in which the blade is received within the handle 12. FIG. 2 illustrates the pocket knife 10 with the blade 14 in an open or use position. The blade 14 of the pocket knife 10 of the present invention is capable of being locked securely in that open position to prevent the inadvertent movement of the blade to its closed position, and this ability makes the knife safer to use.

Figure 3:
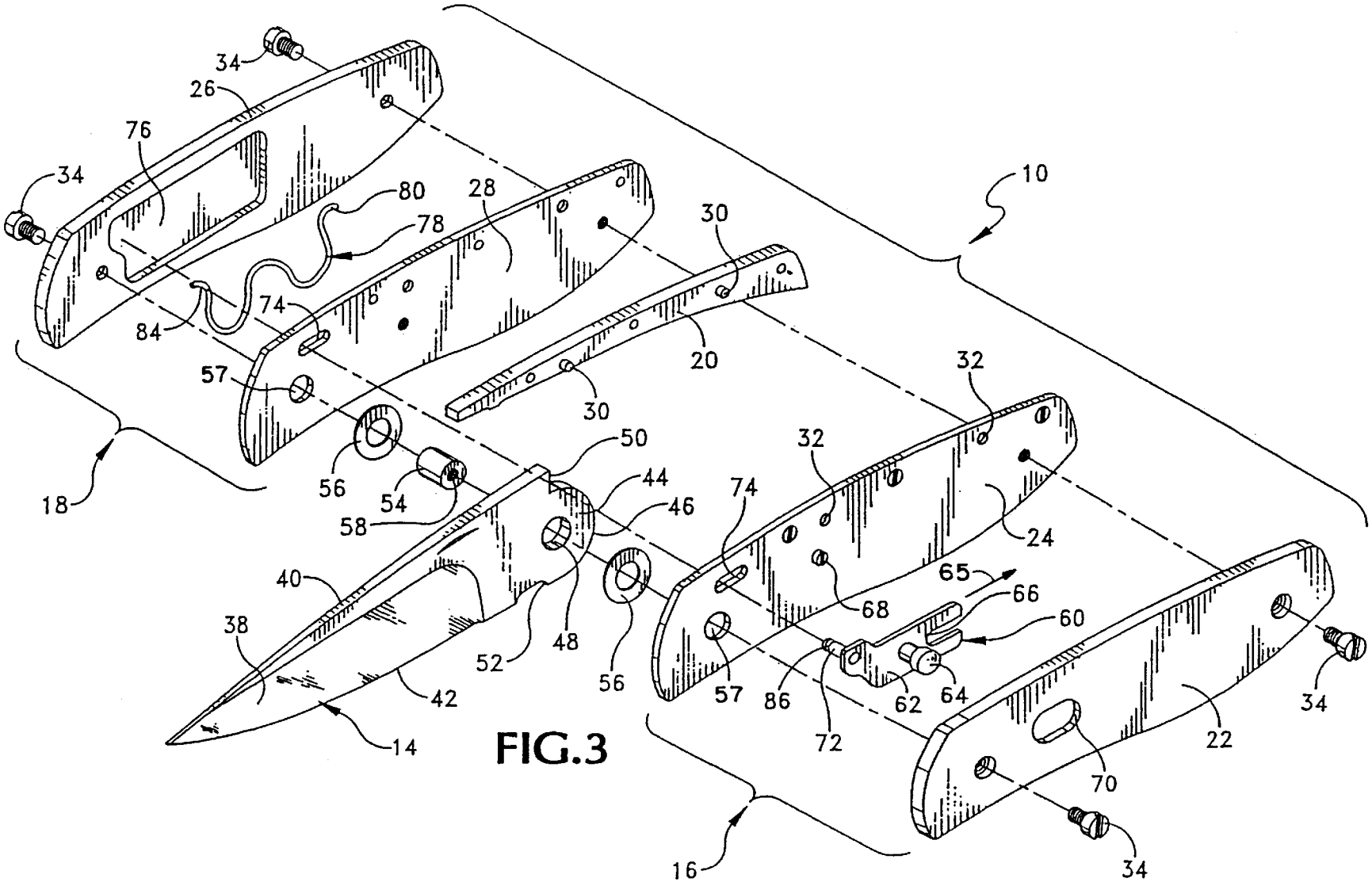
FIG. 3 is an exploded perspective view of the knife shown in FIG. 2.

Referring now to FIGS. 1–3, the handle 12 of the pocket knife 10 comprises several components, including a pair of oppositely located side wall sections, generally indicated at 16, 18, that are parallel with each other, and a spine section 20 which is located between the side wall sections along their upper long edges. As shown in FIG. 3, the side wall section 16 has an outer plate 22 and an inner liner 24, disposed inwardly alongside the outer plate 22. Similarly, the other side wall section 18 has an outer plate 26 and an inner liner 28 also disposed inwardly alongside its outer plate 26.

When the handle 12 is assembled, the spine section 20 is disposed between the liners 24, 28 of the side wall sections 16, 18, respectively, and extends along the upper edge margins of the side wall sections. Outwardly projecting detents 30 provided on the spine section are received in corresponding bores 32 formed in the liners, to align the side wall sections with each other and the spine section. Suitable fasteners such as screws 34 and 35 are used to hold together the side wall sections 16, 18 and the spine section 20. Preferably, the outer plates 22, 26 of the side wall sections 16, 18, respectively, are fabricated from a reinforced hard synthetic plastics material such as Micarta® (by Westinghouse Electric & Manufacturing Company), although other suitable materials such as metal, other plastics, wood, etc. can also be used. The liners 24, 28 of the side wall sections 16, 18, and the spine section 20, are preferably fabricated from steel or titanium since these components of the handle must be strong enough to bear the forces that might be exerted thereon when locking the blade in its open position.

The side wall sections 16, 18 and the spine section 20 define a blade receiving groove 36 (see FIG. 4) for receiving the blade 14 when it is moved to its closed position. Still referring to FIGS. 1–3, the blade 14 comprises an elongate working portion 38 having an upper blunt edge or back 40, a lower sharp edge 42, and a tang portion 44 which pivotally attaches the blade to the handle 12. The arrangement is such that the blade's working portion 38 extends away from the handle 12 when the blade 14 is in its open position, and the tang portion 44 is located within the groove 36 when the blade is in either the open or the closed position. That is, the tang portion 44 is always located between the liners 24 and 28 of the handle 12.

More specifically, the working portion 38 is constructed in a well-known manner and is pivotally attached to the handle by the tang portion 44 so that the lower sharp edge 42 is received within the handle 12. The tang portion 44 is formed integrally with the blade portion 38 and has a semi-circularly-shaped peripheral edge 46, and a circular opening 48 is formed in the tang for attaching the blade 14 to the handle 12. One of the ends of the peripheral edge 46 of the tang portion 44 merges into an outwardly extending first shoulder 50. The other end of the peripheral edge 46 merges into an inwardly extending second shoulder 52. The first and second shoulders 50, 52 are generally perpendicular with the direction of the peripheral edge 46 at their respective junctions; however, it should be observed as in FIG. 4 that the second shoulder 52 merges into the peripheral edge 46 with a greater radius of curvature than does the first shoulder 50.

As shown in FIG. 3, an annular shaft 54 fabricated from hard steel attaches the blade 14 to the handle 12 with one of a pair of annular shims 56 on each side, between the liners 22 and 28. The shaft 54 is press-fitted into the opening 48 formed in the tang portion 44 of the blade 14 and fits rotatably but snugly through circular openings 57 defined in the liners 22 and 28 so that the shaft defines a pivot axis for the blade extending transversely with respect to the side walls 16 and 18. The annular shims 56 are received over respective ends of the shaft 54 as indicated in FIG. 3. The shaft 54 has a threaded axial bore 58 machined therethrough for matingly receiving the screw fasteners 34 which retain the outer plates 22 and 26 and keep the pocket knife 10 assembled.

Figure 4:
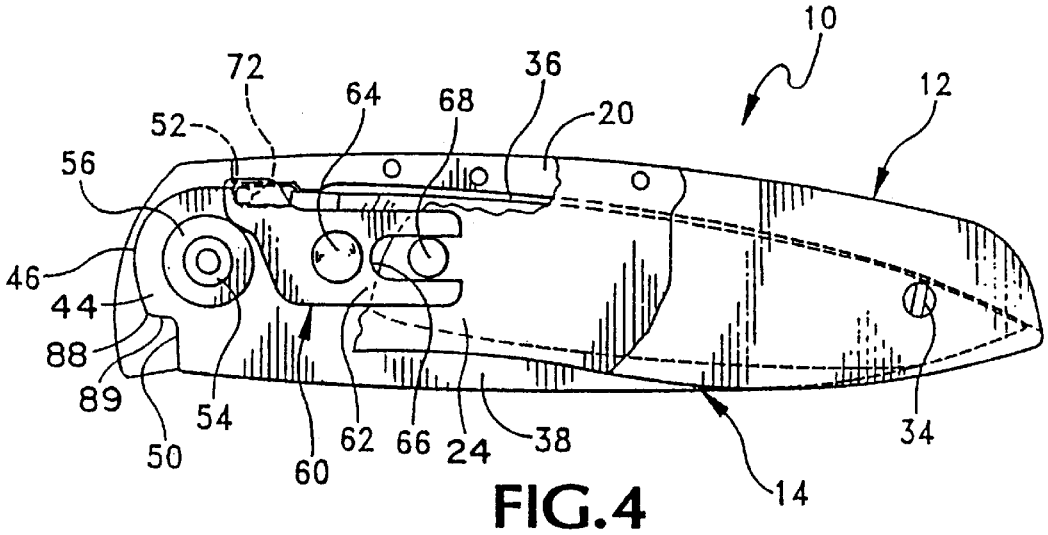
FIG. 4 is a partially cutaway elevational view from one side of the knife shown in FIGS. 1–3.
Figure 5:
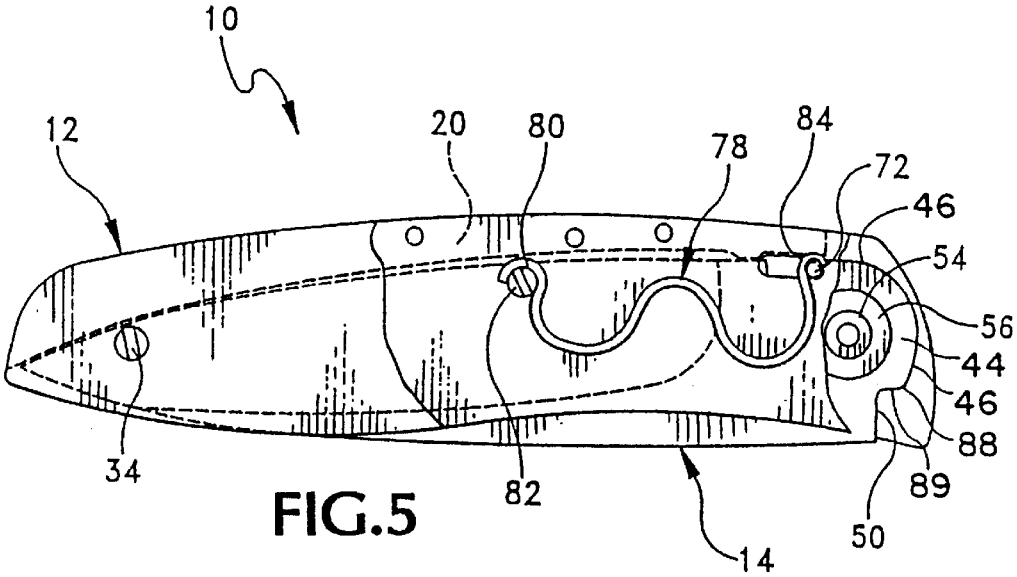
FIG. 5 is a partially cutaway elevational view from the other side of the pocket knife shown in FIGS. 1–4.

Referring now to FIGS. 3–5, there is generally indicated at 60 a sliding lock assembly for locking the blade 14 in its open position. The sliding lock assembly 60 includes a planar sliding body member 62 which extends along a plane generally parallel with the plane of the side wall sections 16, 18 of the handle 12. Mounted on the body member 62 is an outwardly projecting latch operating arm member or knob 64 useful as a handle for slidably moving the body member 62 along an axis generally parallel with the length of the handle 12 as indicated by the arrow 65 in FIG. 3. The body member 62 is disposed between the outer plate 22 and liner 24 of the side wall section 16 in a cavity (not shown) formed in the inwardly-facing side of the outer plate 22. The body member 62 has a fork or slot 66 formed therein which receives a guide member 68 (e.g., a machine screw) suitably attached to the liner 24 to guide the movement of the sliding body member 62. The knob 64 extends outwardly through an elongated opening 70 formed through the plate 22 of the side wall section 16 so that it is accessible to the user of the pocket knife 10.

The sliding lock assembly 60 further includes a cylindrical blade locking pin 72 of which one end is attached (e.g., welded) to the body member 62. The pin 72 has a cylindrical outer surface 73, and a central axis that extends in a generally transverse direction with respect to the body member and handle 12. When the folding knife 10 is assembled, the pin 72 extends through aligned elongate openings 74 formed in the liners 24, 28 of the side wall sections 16, 18, respectively, and the free end of the pin 72 extends into a large cavity 76 formed in the inwardly facing surface of plate 26 of side wall member 18. An inwardly facing surface 77 of the spine 20 is preferably aligned with or nearly aligned with the elongate openings 74, as may be seen best in FIG. 7*a*. As shown in FIG. 4, the pin 72 of the sliding lock assembly 60 is located adjacent the tang portion 44 of the blade 14.

Figure 6:
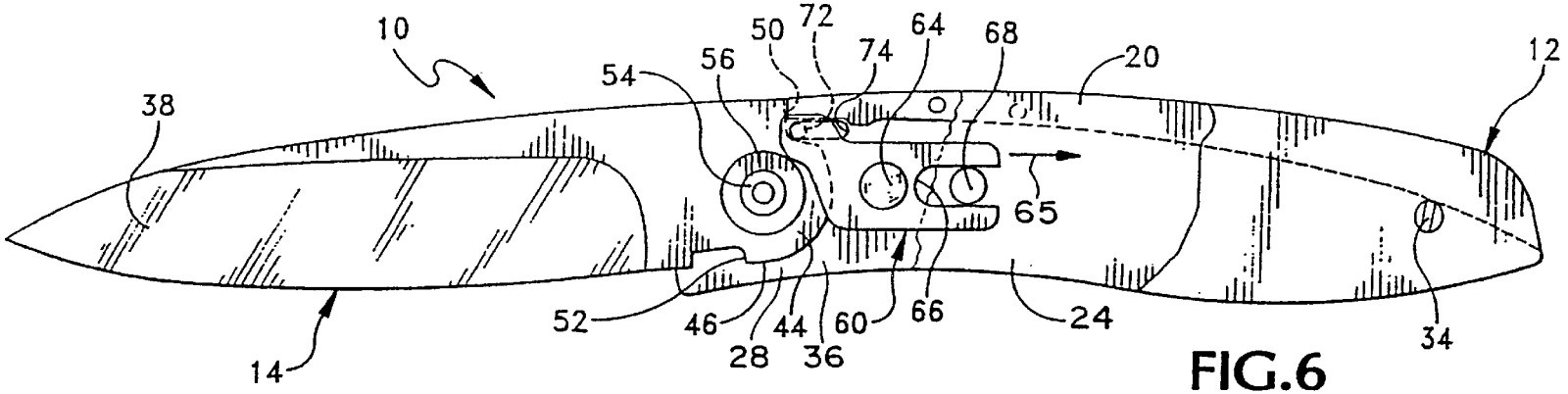
FIG. 6 is a partially cutaway elevational view of the pocket knife from the same side as in FIG. 4, the blade being illustrated in its open position.
Figure 7:
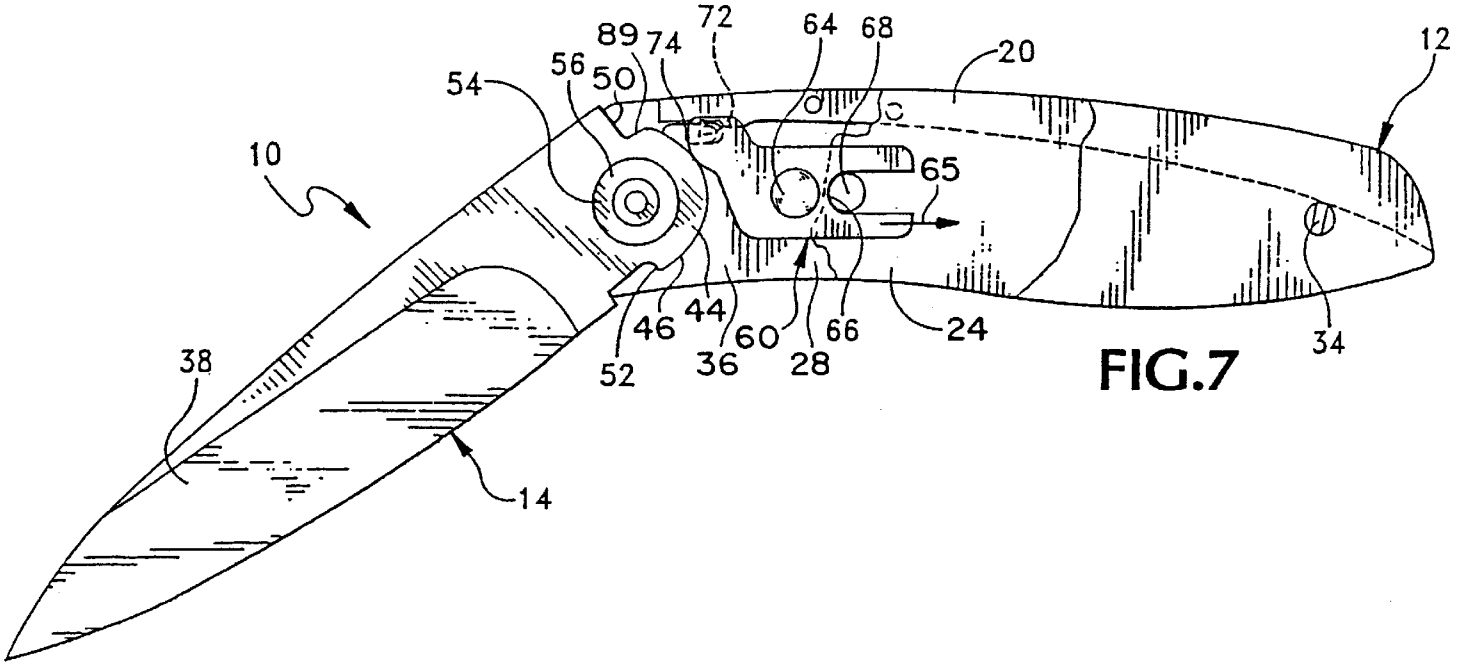
FIG. 7 is a partially cutaway elevational view of the pocket knife, similar to FIG. 6, but with the blade of the knife moved toward its closed position.
Figure 6A:
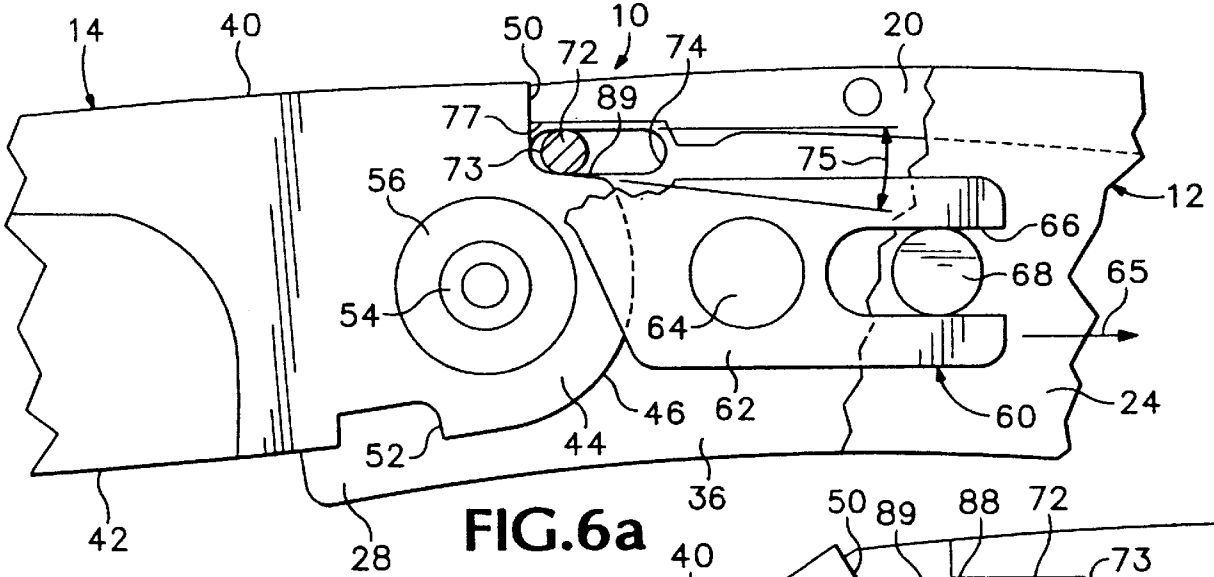
FIG. 6*a* is a detail view of the locking mechanism of the knife as shown in FIG. 6, at an enlarged scale.
Figure 7A:
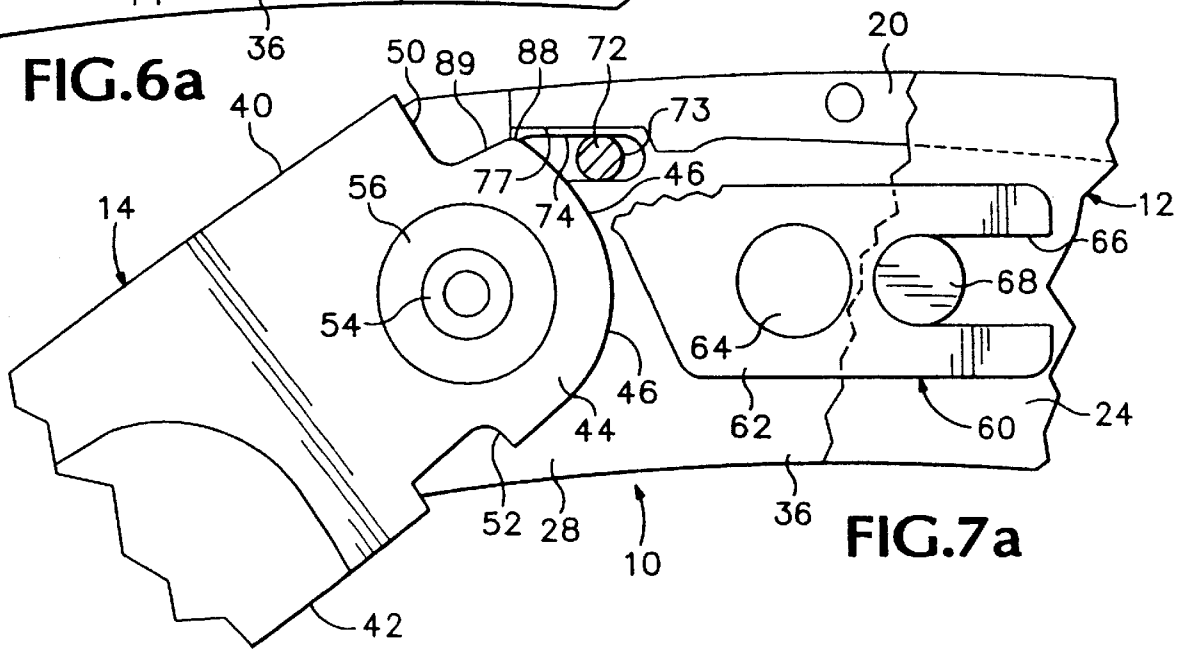
FIG. 7*a* is a detail view of the folding knife as shown in FIG. 7, at an enlarged scale.

Turning now to FIGS. 6 and 7, the sliding lock assembly 60 is movable in a direction parallel to the length of the handle 12, as indicated by the arrow 65, between a first position shown in FIG. 6, in which the cylindrical outer surface 73 of blade locking pin 72 of the sliding lock assembly engages the tang portion 44 of the blade 14 to lock the blade in its open position, and a second position, shown in FIG. 7, in which the pin 72 is spaced away from the tang portion 44 to allow the blade to move from its open position and toward its closed position. More specifically, when the sliding lock assembly 60 is in its first position for locking the blade 14 in its open position, the pin 72 is disposed in a recess defined by the tang portion 44, the first shoulder 50, and spine section 20. As may be seen best in FIG. 7*a*, a generally flat locking surface 89 is part of the peripheral edge 46 of the tang 44, intersecting and preferably faired into the semi-circular portion through the transition 88. The locking surface 89 extends inwardly along a chord of the circle defined by the semi-circular portion of the peripheral edge 46. An angle 75, shown in FIG. 6*a*, is defined between the locking surface 89 of the tang 44 and the upper inner surfaces defining the elongate holes 74. The angle 75 is between 7 degrees and 14 degrees and is preferably 10 degrees, and thus is small enough that the pin 72 is not urged longitudinally away from its first position by any cam action of the locking surface portion 89 of tang 44 with sufficient force to overcome the force of the spring 78. The arrangement is such that upon an attempt to move the blade 14 from its open position, the pin 72 engages the locking surface 89 portion of the peripheral edge 46 of the tang portion 44 of the blade and interferes with the pivotal movement of the tang portion, thus preventing movement of the blade 14 about the pivot axis defined by the shaft 54.

Additionally, it should be observed that the pin 72 of the sliding lock assembly 60 has a tendency of "wearing in" rather than wearing out, since the more frequently the blade 14 is moved to its open position and locked therein by the pin, the further the pin becomes wedged between the peripheral edge 46 of the tang portion 44, the surfaces defining the elongate openings 74 in the liners 22 and 28, and (depending upon alignment) the inner surface 77 of the spine 20.

A spring 78 is provided for biasing the pin 72 of the sliding lock assembly 60 to its first position. As illustrated in FIG. 5, one end 80 of the spring 78 engages a detent 82 (e.g., a machine screw) provided on the liner 28 of the side wall section 18. The other end 84 of the spring 78 engages the free end of the pin 72. More specifically, a circumferential groove 86 is formed in the pin 72 near its free end to receive the end 84 of the spring 78 therein and ensure that the spring maintains its engagement with the pin 72. Preferably, the spring 78 is fabricated from resilient material which is strong enough for biasing the sliding lock assembly 60 to its first position, but resilient enough so that when a person applies a force on the knob 64 in a direction away from the extended blade 14, the lock assembly 60 is moved readily to its second position.

It should be observed that the peripheral edge 46 of the tang portion 44 defines a cam upon which the pin 72 can ride as the blade 14 is moved between its open and closed positions. Moreover, referring briefly to FIG. 4, when the blade 14 in its closed position the pin 72 is disposed between the peripheral edge 46 of the tang portion 44 and the second shoulder 52, and upon movement of the blade 14 away from its closed position the second shoulder moves the sliding lock assembly 60, including the pin 72, to its second position, enabling the blade 14 to open. It should also be noted that the tang portion 44 of the blade 14 can be configured so that the blade is locked in its closed position and capable of being moved only upon moving the sliding lock assembly 60 manually to its second position.

Another important feature of the tang portion of the blade 14 is that the shape of the peripheral edge 46 which defines the cam upon which the pin 72 rides can provide an "assist" when opening or closing the blade 14 of the knife 10. More specifically, as illustrated in FIGS. 4 and 5, the arrangement is such that during closing of the blade 14 of the knife 10 the pin 72 rides along the peripheral edge 46 until it rounds over the corner at the junction of the peripheral edge and the second shoulder 52. After rounding over the junction with the second shoulder the pin 72 actually assists in closing the blade 14, since the spring 78 biases the pin 72 toward the shoulder 52 and thus urges the blade 14 toward its closed position.

Turning now to FIGS. 6, 6*a*, 7 and 7*a*, when opening the blade 14, a transition at 88 in the curvature of the peripheral edge 46 also makes it possible to take advantage of the spring biased pin 72 acting on the tang portion 44 to assist in opening the blade, since the blade locking surface portion 89 of the peripheral edge 46 of the tang 44 extends at an angle inward from the arcuate portion of the peripheral edge.

Figure 8:
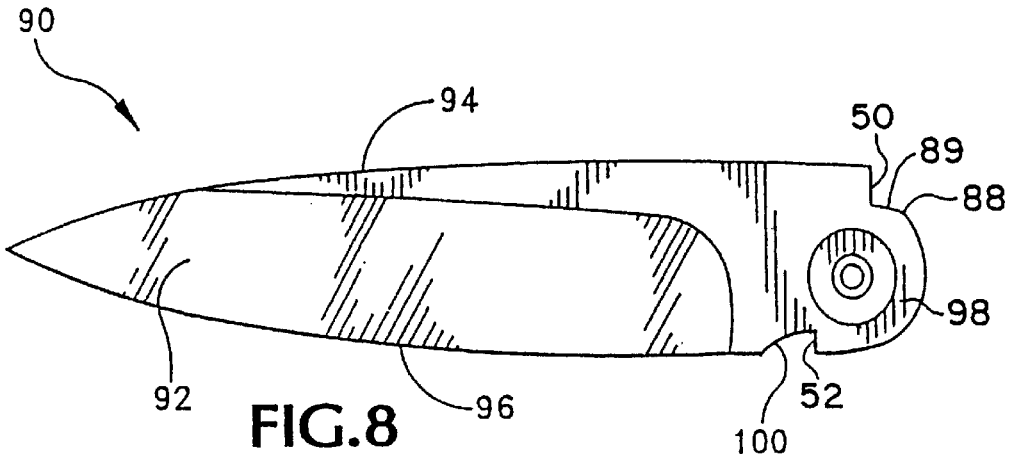
FIG. 8 is a side elevational view of a blade for incorporation in a knife that is another preferred embodiment of the invention.

FIG. 8 illustrates a blade 90 of another embodiment of the invention. The blade 90 is similar to the blade 14 in that it includes a blade portion 92 having an upper edge 94, a lower edge 96, and a tang 98 generally similar to the tang 44. However, the tang 98 also includes a ramp 100. The purpose of ramp 100 is to allow the locking assembly 60 to assist in opening of the blade 90 from its closed position. Referring briefly to FIG. 4, when the knob 64 is moved toward the second position of the lock assembly 60 (in the direction of arrow 65) the pin 72 pushes against ramp 100, causing partial opening of the knife by cam action. This is desirable so that the knife can be opened with one hand.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A folding knife, comprising:

(a) a handle having a pair of opposite ends and including a pair of elongate side walls spaced apart from each other and defining a blade receiving groove therebetween, each of said side walls defining one of a pair of elongate openings located opposite each other;

(b) a blade pivotally attached to said handle proximate one of said ends and movable about a pivot axis extending transversely with respect to said side walls, between a closed position and an open position of said blade, said blade having an elongate working portion and a tang, said elongate working portion being received within said groove when said blade is in said closed position and extending away from said handle when said blade is in said open position, and said tang being located between said side walls when said blade is in said open position;

(c) said tang having a peripheral edge including a locking surface portion thereof;

(d) a blade locking pin extending transversely with respect to said handle and having a pair of opposite end portions each extending through a respective one of said elongate openings defined in said side walls, said blade locking pin having an outer surface of which a portion is located between said side walls, and said blade locking pin being movable longitudinally of said elongate openings between a first position, in which said outer surface engages said locking surface portion of said tang when said blade is in said open position and thus locks said blade in said open position, and a second position in which said locking pin is spaced away from said locking surface portion of said tang, thus allowing said blade to move from said open position; and (e) a spring disposed between said handle and said locking pin, said spring urging said locking pin toward said first position along a path defined by said elongate openings in said side walls.

2. The folding knife of claim 1 wherein said handle includes a pair of liners and said elongate openings are defined by said liners and extend therethrough.

3. The folding knife of claim 2 wherein said handle includes a pair of outer plates of which one is disposed exteriorly of each of said liners, each of said outer plates defining a respective cavity adjacent one of said elongate openings and each of said elongate openings communicating between said groove and the respective cavity.

4. The folding knife of claim 3 wherein said spring is located within one of said cavities.

5. The folding knife of claim 2, including a lock assembly body member fixedly attached to said locking pin, said body member extending alongside one of said liners and being movable along said one of said liners, thereby moving said blade locking pin between said first and second positions.

6. The folding knife of claim 1 wherein said locking pin is carried on a lock assembly body member extending longitudinally of said handle and located movably within one of said side walls.

7. The folding knife of claim 6, including a latch operating arm attached to said lock assembly body member and projecting outwardly through an opening defined in said one of said side walls.

8. The folding knife of claim 1, including a spine disposed between said side walls and including an inner surface facing toward said locking surface portion of said tang and spaced apart from said locking surface portion of said tang when said blade is in said open position.

9. The folding knife of claim 8 wherein said inner surface of said spine is aligned with both of said elongate openings and respective portions of said outer surface of said locking pin engage both said inner surface of said spine and said locking surface portion of said tang when said locking pin is in said first position.

10. The folding knife of claim 1 wherein said peripheral edge of said tang includes a ramp surface located so that said blade locking pin engages said ramp and forces said blade from said closed position toward said open position when said in is moved from said first position toward said second position.

* * * * *